US006722815B2

(12) United States Patent
Fervers

(10) Patent No.: US 6,722,815 B2
(45) Date of Patent: Apr. 20, 2004

(54) SOIL COMPACTING DEVICE COMPRISING A VIBRATION GENERATOR, AND METHOD FOR CONTROLLING THE VIBRATION GENERATOR

(75) Inventor: Wolfgang Fervers, Munich (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/381,079

(22) PCT Filed: Sep. 19, 2001

(86) PCT No.: PCT/EP01/10818

§ 371 (c)(1),
(2), (4) Date: Mar. 18, 2003

(87) PCT Pub. No.: WO02/25015

PCT Pub. Date: Mar. 28, 2002

(65) Prior Publication Data

US 2003/0180093 A1 Sep. 25, 2003

(30) Foreign Application Priority Data

Sep. 19, 2000 (DE) ..... 100 46 336

(51) Int. Cl.[7] ..... E01C 23/07; E01C 19/30; E02D 3/02

(52) U.S. Cl. ..... 404/75; 404/84.1; 404/113; 404/133.05; 404/133.1; 405/271

(58) Field of Search ..... 404/75, 102, 113, 404/117, 133.05, 133.1, 84.1; 405/271

(56) References Cited

U.S. PATENT DOCUMENTS 4,481,835 A * 11/1984 Storm ..... 74/61
5,164,641 A * 11/1992 Quibel et al. ..... 318/128
5,177,415 A * 1/1993 Quibel et al. ..... 318/128
5,727,900 A * 3/1998 Sandstrom ..... 404/84.1
6,213,681 B1 * 4/2001 Sick et al. ..... 404/133.05
6,431,790 B1 * 8/2002 Anderegg et al. ..... 404/75
6,619,125 B2 * 9/2003 Laugwitz ..... 73/573

FOREIGN PATENT DOCUMENTS

| | | |
|---|---|---|
| WO | WO 95/10664 | 4/1995 |
| WO | WO 98/17865 | 4/1998 |
| WO | WO 01/81680 | 11/2001 |

* cited by examiner

*Primary Examiner*—Gary S. Hartmann
(74) *Attorney, Agent, or Firm*—Boyle Fredrickson Newholm Stein & Gratz S.C.

(57) ABSTRACT

The invention relates to a soil compacting device comprising a vibration generator that acts upon a soil contact plate. A controlling means of the vibration generator comprises an amplitude-controlling unit and a frequency-controlling unit. The amplitude-controlling unit diminishes the vibration amplitude by a first amplitude difference when a jumping of the soil contact plate is detected. When no jumping is detected within a clock timing, the amplitude-controlling unit increases the vibration amplitude by a second amplitude difference. The frequency-controlling unit determines the driving power that is output by a drive to the vibration generator and changes the vibration frequency so that the driving power approximately corresponds to a preset value. The amplitude control and the frequency control are advantageously carried out in parallel.

18 Claims, 2 Drawing Sheets

SOIL COMPACTING DEVICE COMPRISING A VIBRATION GENERATOR, AND METHOD FOR CONTROLLING THE VIBRATION GENERATOR

BACKGROUND OF THE INVENTION

1. Field of the Invention

The present invention relates to a soil compacting device having a vibration generator that impinges on a soil contact element, as well as to a method for controlling the vibration generator.

2. Description of the Related Art

Soil compacting devices, for example vibration plates or vibrating rollers, are known in which a soil contact element, such as a plate or the tire of a roll, receives a vibration produced by a vibration generator.

The compacting of the soil takes place in that the soil compacting device travels over it once or a plurality of times, resulting in a modification of the solidity of the soil, and thus also a modification of its vibration characteristic. If the soil is already highly compacted and the compacting power delivered by the soil compacting device is great, the soil compacting device can begin to "jump," in that the soil contact plate or roll tire lifts off the soil after each contact with the soil. This not only represents a waste of energy, but is also disadvantageous for the compacting that has already taken place, because local loosenings of the soil can result. Moreover, a jumping of the soil compacting device leads to considerable stress on the operator of the device.

From WO-A-98-17865 and WO-A-95-10664, vibration compacting devices are known in which the operational state of jumping is automatically reacted to by modifying the vibration produced by the vibration generator.

In the devices or methods known from the prior art, the frequency of the vibration generator is standardly adapted to the previously determined soil characteristics. For this purpose, for example in WO-A-98-17865 the state of the soil is determined through the costly evaluation of various measurement signals. In particular, for this purpose it is necessary to determine the movement of the soil contact element, which is a component of a vibrating lower mass. Furthermore, the set frequency and the precise position of the vibration generator must be measured.

In addition, soil compacting devices are known in which the amplitude of the vibration produced by the vibration generator is reduced in such a way that jumping of the soil compacting device can no longer occur. However, the limitation of the amplitude at a predetermined frequency has the result that it is no longer possible to use the entire available drive power for which the vibration generator is designed for the compacting of the soil. The consequence of this is a correspondingly lower operational efficiency.

FIG. 3 shows a known vibration plate used as a soil compacting device, which can be guided by an operator at a drawbar 1. A drive 2, appertaining to an upper mass, drives a vibration generator 3 appertaining to a lower mass, and this vibration generator produces a vibration that is communicated to a soil contact plate 4. Vibration generator 3 is standardly a one-shaft or two-shaft generator, in which one or more imbalance masses are correspondingly distributed on one or two shafts. The design of such a vibration plate is known, so that further description is not required.

Vibrating rollers used as soil compacting devices are also constructed in a similar, known manner.

OBJECTS AND SUMMARY OF THE INVENTION

The invention is based on the object of indicating a soil compacting device comprising a vibration generator, as well as a method for controlling the vibration generator, in which an optimal exploitation of the power supplied by the drive is ensured.

According to the present invention, this object is achieved through a soil compacting device according to claim 1, and through a method according to claim 11.

Advantageous further developments of the present invention are defined in the dependent claims.

The basic idea of the present invention is to provide respective control units for the amplitude and for the frequency of the vibration produced by the vibration generator, and to realize these using simple means. Above all, in the interaction of the two control units it is possible to optimally exploit the available drive power, for example of a drive motor, without the occurrence of the undesired "jumping" of the soil compacting device.

In the combination according to the present invention of amplitude controlling and frequency controlling, this is enabled in that the vibration amplitude is always kept within the region bordering on jumping. If this boundary region changes, for example making it necessary to reduce the amplitude of the vibration, the frequency control unit tracks this by increasing the vibration frequency correspondingly, in order to use the drive energy that becomes available as a result of the reduction of the vibration amplitude in the form of a higher frequency. In this way, the drive energy can be used as completely as possible for the soil compacting, without the beginning of jumping on the part of the soil compacting device.

The controlling of the amplitude is based on the principle that whenever a jumping of a soil contact element is recognized, the amplitude is reduced. The monitoring of whether the soil contact element is jumping takes place continuously, or regularly, in the context of a predetermined clock pulse. After a modification of the amplitude, there thus takes place a new determination of the state of vibration of the soil contact element. If the soil contact element is still jumping, a further reduction of the amplitude takes place. However, if no jumping is recognized, the amplitude is not held constant at approximately the existing value, but rather is again increased, though with a smaller gradient. As a consequence, the amplitude is constantly being modified, either by a significant reduction if jumping has been determined, or by a slight increase if no jumping has been determined. In this way, it is achieved that the soil compacting device is always moved in the boundary region between jumping and not jumping.

The modification of the vibration amplitude can be carried out constantly and continuously; here it is preferable that the reduction of the vibration amplitude take place with a stronger gradient than does the increasing. Alternatively, in particular given a digital controlling of a timing element, a clock pulse can be predetermined during which the detection device determines the state of vibration of the soil contact element. If the special state of vibration has been recognized, the amplitude of the vibration can be reduced incrementally by a first amplitude difference. However, if no special operating state has been recognized in the clock pulse, the amplitude of the vibration is increased incrementally by a second, preferably smaller, amplitude difference. The clock pulse can also be set short enough that a quasi-continuous modification of the amplitude of the vibration results.

The controlling according to the present invention of the frequency of the vibration is based on the idea that the predetermined drive power, for example that delivered by a drive motor, for the soil compacting is always to be exploited optimally, i.e., to the maximum extent. For this purpose, the drive power delivered to the vibration generator is determined using a power determination device, and is compared with a target value, namely the previously determined value for an optimal drive power, and the frequency controlling device maintains the determined actual drive power in the region of the predetermined value by correspondingly adapting the frequency produced by the vibration generator.

Though the amplitude control unit and the frequency control unit each by themselves already provide a significant improvement of known control devices, and in particular provide an increase in operational efficiency, a coupling of the two control units makes further improvement possible.

BRIEF DESCRIPTION OF THE DRAWINGS

These features, and further advantages and features of the present invention, are explained in more detail below on the basis of preferred specific embodiments of the invention, with the aid of the accompanying Figures.

DETAILED DESCRIPTION OF THE PREFERRED EMBODIMENTS

Figure 1:
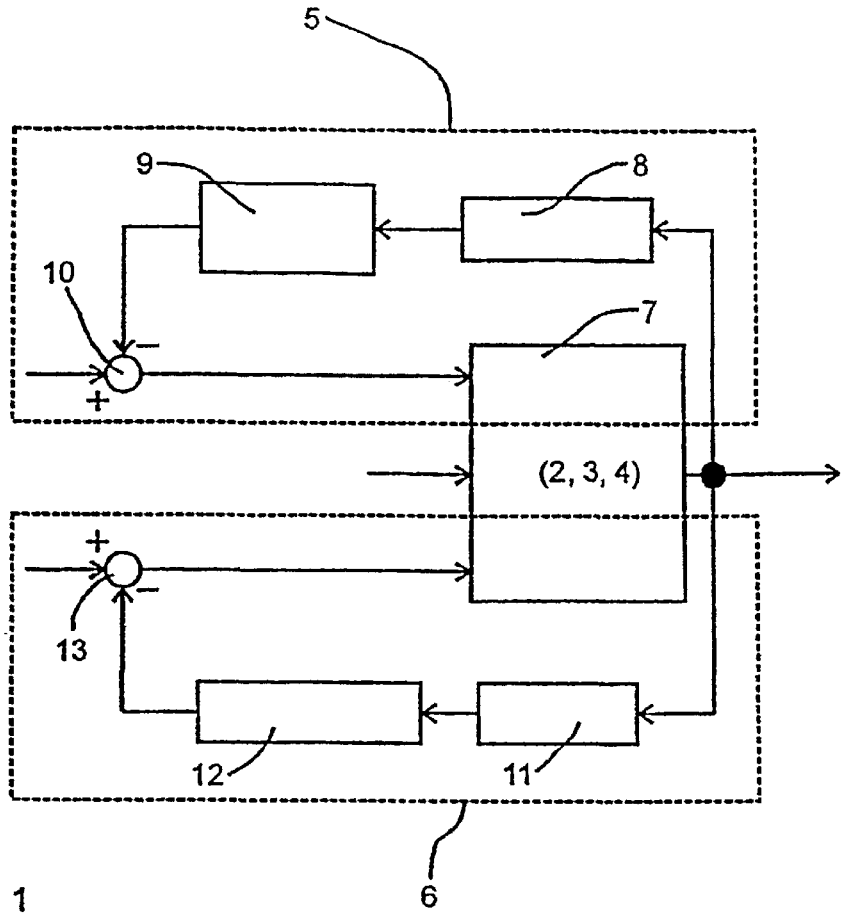
FIG. 1 shows a block diagram of the control device according to the present invention for a soil compacting device.

FIG. 1 shows a block diagram of the design of a control unit according to the present invention for the vibration generator of a soil compacting device. The control unit is essentially made up of two components situated parallel to one another, namely an amplitude control device 5 and a frequency control device 6.

Figure 3:
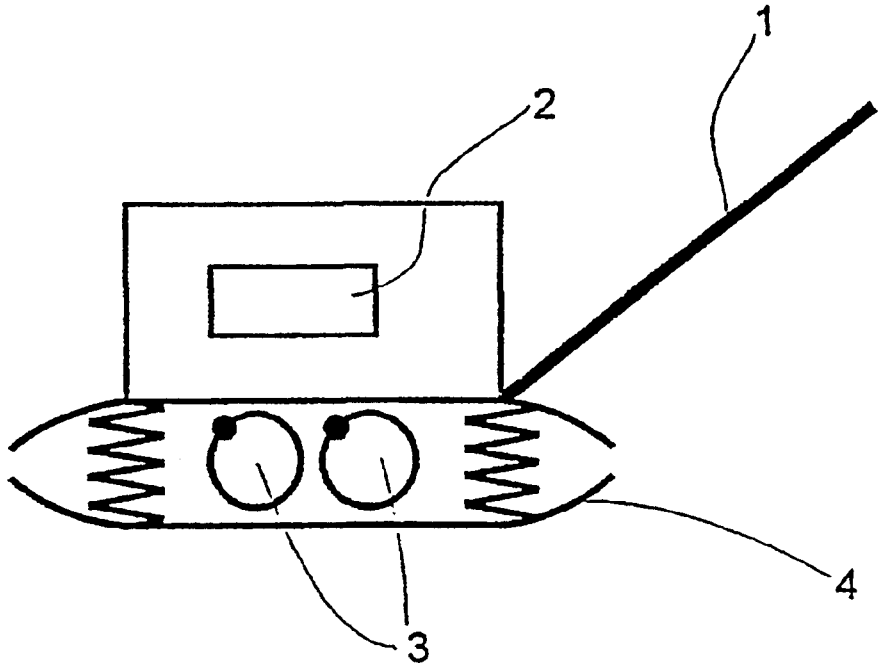
FIG. 3 schematically shows the design of a known vibration plate used as a soil compacting device.

Both control devices 5, 6 influence an operational state 7 of the soil compacting device, which in turn is essentially represented by the following elements (already described in connection with FIG. 3): drive 2, vibration generator 3, and soil contact element 4.

In the following, the construction of the amplitude control device 5, and its operational principle, is explained.

A component of amplitude control device 5 is a detection device 8 with which it can be determined whether soil contact element 4 is jumping, i.e., whether it is lifting off the soil or not. This "jumping" operational state can for example be recognized with the aid of known methods, such as those indicated in WO-A-98-17865 or in WO-A-95-10664.

Alternatively, from DE-A-100 19 806 a detection device is known in which a detection mass that can be moved elastically in relation to the soil contact element is provided, and the motion of the detection mass is measured using a measurement device. If the motion, in particular the amplitude of vibration, of the detection mass exceeds a predetermined value, this can be interpreted as jumping of the soil contact element due to excessive impact energy.

The information as to whether soil contact element 4 is jumping or not is given to a control unit 9 by detection device 8.

Control unit 9 evaluates the jumping information from detection device 8, and controls an adjustment device 10 for adjusting the amplitude of vibration at vibration generator 3 in accordance with predetermined rules.

The control algorithm comprises two control measures. According to a first control measure, the amplitude of vibration is reduced incrementally by a first amplitude difference k1 if detection device 8 has recognized a special state of vibration, namely a jumping of soil contact element 4.

If, in contrast, detection device 8 has recognized that no special state of vibration, i.e. no jumping, is present, the amplitude of vibration is increased incrementally by a second amplitude difference k2.

For the chronological controlling of these control measures, a timing element is provided in or on control unit 9 in order to produce a clock pulse. In each clock pulse, which can for example last a fraction of a second, control unit 9 evaluates the signal of detection device 8, and initiates a corresponding measure by controlling adjustment device 10. This process is repeated in the next clock pulse.

This control algorithm has the result that the amplitude of the vibration is modified constantly, that is, in each clock pulse. If the amplitude of the vibration has been reduced by first amplitude difference k1, and a jumping is subsequently still detected, a renewed reduction by first amplitude difference k1 is initiated. In contrast, if jumping no longer occurs, the amplitude is no longer reduced, but rather is increased by second amplitude difference k2, which is smaller than first amplitude difference k1, so that an interplay of reduction and increasing of the amplitude arises. In this way it is achieved that the soil compacting device is always moved in the boundary region between jumping and not jumping.

Figure 2:
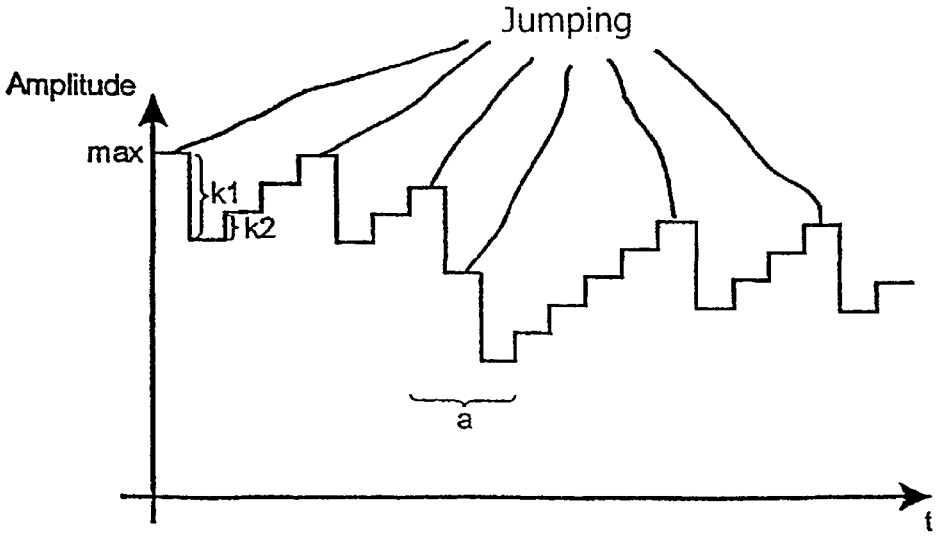
FIG. 2 shows an example of the control measures of the amplitude control device according to the present invention.

FIG. 2 shows, in a diagram, the amplitude of the vibration plotted over time. When the soil compacting device is started, first a maximum amplitude is set. In the present case, it is recognized immediately after the starting that soil contact element 4 has started to jump, so that the amplitude of the vibration is reduced by the value k1 (first amplitude difference). Subsequently, it is determined that soil contact element 4 is no longer jumping, so that subsequently, in a plurality of steps (in three steps in FIG. 2), the amplitude is increased in each step by second amplitude difference k2 until jumping is again determined, etc.

In the time region designated "a," the soil compacting device is clearly traveling over a region of soil that can accept only a limited amount of impact energy. As a result, the amplitude of the vibration must be reduced twice, and finally assumes only a comparatively small value. After this there is a recovery period, with an associated increase in the amplitude of vibration.

Alternatively to the described incremental modification of the amplitude of vibration, which is suitable in particular for digitally designed control units, control algorithms are possible having a continuous modification of the amplitude of the vibration. Correspondingly, the diagram in FIG. 2 would take on not a stepped curve, but rather a wave-shaped curve.

The amplitude controlling according to the present invention makes it possible for the soil compacting device to compact the soil with the greatest possible amplitude at all times, amplitude control device 5 having a design that is considerably simplified over the prior art.

However, a controlling of the amplitude alone would have the additional disadvantage that the drive power provided by drive 2 would not always be fully exploited. For this reason, the overall control device according to the present invention, shown in FIG. 1, also comprises frequency control device 6, which represents an additional control loop for adapting the frequency of vibration generator 3.

The basic idea of the frequency control device is that the existing or predetermined drive power is always to be exploited completely for soil compacting.

For this purpose, a component of frequency control device 6 is a power determination device 11, with which the power delivered to vibration generator 3 by drive 2 can be measured.

In a control unit 12, the measured actual drive power is compared with a predetermined target value. If the measured drive power lies below the target value, the frequency of vibration generator 3 is increased via an adjustment device 13, or is reduced in the converse situation.

Power determination device 11 can be constructed in various ways. If it is assumed that drive 2 is a motor, then for example the motor RPM and the motor torque can be measured. If, in contrast, drive 2 is a hydraulic aggregate, and vibration generator 3 is driven hydraulically, then the pressure prevailing in the hydraulic line can also be used to determine the torque. If the vibration generator is driven by an electric motor, a measurement of electrical characteristic quantities is also possible.

In a particularly advantageous example for the realization of the present invention, the performance characteristic of the motor, i.e., the relationship between the motor power and the motor RPM, is used to determine the delivered power, i.e., the actual drive power for vibration generator 3. The performance characteristic of the motor is generally known, and represents an unambiguous relationship between a predetermined motor power and a motor RPM. In this way, the drive power delivered by the motor to vibration generator 3 can be determined solely with the aid of the RPM of drive motor 2, which is relatively simple to measure.

A controlling of the frequency of vibration generator 3 in order to keep the drive power constant can then be carried out through a comparison of the measured motor RPM and the target motor RPM associated with the predetermined target drive power.

If the actual motor RPM is less than the target motor RPM, the frequency of vibration generator 3, i.e., the RPM of the imbalance shafts provided in vibration generator 3, is reduced, so that stress on the motor is relieved and its RPM can increase to the predetermined value. If, in contrast, the actual motor RPM is greater than the target RPM, this means that the motor is loaded too lightly, so that the RPM of the imbalance shafts in vibration generator 3 is increased in order to fully exploit the drive power that can be provided by the motor.

The adjustment of the frequency of vibration generator 3, i.e., the modification of the RPM of the imbalance shafts situated in vibration generator 3, is carried out through adjustment device 13. Known construction elements can be used in the realization of adjustment device 13. For example, given a hydraulic transmission of power from drive motor 2 to vibration generator 3, a variable-displacement pump or a hydraulic motor with adjustable RPM can be used. If there is a mechanical transmission of power, cone transmissions, e.g. Heynau transmissions or PIV transmissions, are possible, in which torque is transmitted either via a friction ring or via push-pull chains, as well as friction wheel transmissions (PK transmissions).

If an electrical transmission of power to vibration generator 3 takes place, a modification of RPM using a controllable frequency converter is possible.

Considered separately, amplitude control device 5 and frequency control device 6 each already achieve a better exploitation of the available drive power. If they work together in a parallel arrangement, the efficiency is further increased. In relation to the prior art, control devices 5, 6 are distinguished by simple design, low measurement expense, and an efficient soil compacting with maximum power, achieved through control devices 5, 6.

I claim:

1. A soil compacting device, comprising:

a soil contact element;

a vibration generator that impinges on the soil contact element;

a drive for the vibration generator;

an amplitude control device for controlling the amplitude of a vibration produced by the vibration generator; the amplitude control device comprising:

a detection device for recognizing a special state of vibration of the soil contact element;

an amplitude adjustment device for adjusting the amplitude of the vibration; and an amplitude control unit for controlling the amplitude adjustment device in such a way that, in a first control measure, the amplitude of the vibration is able to be reduced if the detection device recognizes a special state of vibration, and, in a second control measure, the amplitude of vibration is able to be increased if the detection device does not recognize a special state of vibration; and comprising a frequency control device for controlling the frequency of the vibration produced by the vibration generator;

the frequency control device comprising:

a power determination device for determining a drive power delivered by the drive for the vibration generator;

a frequency adjustment device for adjusting the frequency of vibration; and a frequency controlling device for controlling the frequency adjustment device in such a way that the drive power determined by the power determination device is able to be maintained approximately at a predetermined value;

wherein the amplitude control device and the frequency control device are arranged parallel to one another in such a way that a reduction of the drive power, resulting from a reduction of the vibration amplitude by the amplitude control device, for the vibration generator is able to be at least partially compensated by increasing the frequency of vibration, and vice versa.

2. The soil compacting device as recited in claim 1, wherein a reduction or increasing of the amplitude of the vibration is able to be carried out continuously and constantly in such a way that the amplitude of vibration is constantly modified.

3. The soil compacting device as recited in claim 1, wherein the amplitude control device comprises a timing element for the production of a clock pulse; and wherein the amplitude adjustment device is able to be controlled by the amplitude controlling device in such a way that, in the first control measure, the amplitude of the vibration is able to be reduced incrementally by a first amplitude difference (k1) if in a clock pulse the detection device recognizes the special state of vibration, and, in the second control measure, the amplitude of the vibration is able to be increased incrementally by a second amplitude difference (k2), if in a clock pulse the detection device does not recognize a special state of vibration.

4. The soil compacting device as recited in claim 3, wherein a control measure is able to be executed in each clock pulse.

5. The soil compacting device as recited in claim 3, wherein the first amplitude difference (k1) is greater than the second amplitude difference (k2).

6. The soil compacting device as recited in claim 1, wherein the special state of vibration is a state in which a parameter of a vibration of the soil contact element exceeds a predetermined value.

7. The soil compacting device as recited in claim 1, wherein the amplitude control unit is constructed in such a manner that a maximum vibration amplitude is able to be set when the vibration generator is started up.

8. The soil compacting device as recited in claim 1, wherein the predetermined value for the drive power corresponds to a maximum power that the drive is able to continuously deliver.

9. The soil compacting device as recited in claim 1, wherein the drive comprises a motor, and wherein the power determination device comprises an RPM determination device for determining the RPM of the motor.

10. The soil compacting device as recited in claim 1, wherein the drive comprises a hydraulic pump, and wherein the power determination device comprises a pressure determination device for determining the hydraulic pressure produced by the hydraulic pump.

11. A method for controlling a vibration generator for a soil compacting device comprising a soil contact element, on which the vibration generator impinges, for compacting a region of soil, the vibration generator being driven by a drive, comprising a method for controlling the amplitude of vibration of the vibration generator, having the steps:

determining a state of vibration of the soil contact element;

recognizing a special state of vibration of the soil contact element;

modifying the amplitude of vibration in such a way that the amplitude of vibration is reduced if a special state of vibration has been recognized, and that the amplitude of vibration is increased if no special state of vibration has been recognized;

and comprising a method for controlling the frequency of vibration of the vibration generator, having the steps:

determining a drive power delivered by the drive;

comparing the drive power with a predetermined value;

modifying the frequency of vibration in such a way that the drive power corresponds approximately to the predetermined value;

wherein the method for controlling the amplitude of vibration of the vibration generator and the method for controlling the frequency of vibration of the vibration generator are executed in parallel.

12. The method as recited in claim 11, wherein the step of modifying the amplitude of vibration is carried out continuously and constantly in such a way that the amplitude of vibration is constantly modified.

13. The method as recited in claim 11, wherein the step of modifying the amplitude of vibration is carried out in such a way that the amplitude of vibration is reduced by a first amplitude difference (k1) if the special state of vibration has been recognized, and that the amplitude of vibration is increased by a second amplitude difference (k2) if no special state of vibration has been recognized.

14. The method as recited in claim 13, wherein the first amplitude difference (k1) is greater than the second amplitude difference (k2).

15. The method as recited in claim 13, wherein an execution of the method, or at least the modification of the amplitude of vibration, takes place in time periods determined by a clock pulse.

16. The method as recited in claim 11, wherein the predetermined value for the drive power corresponds to a maximum power that the drive is able to continuously deliver.

17. The method as recited in claims 11, wherein the drive comprises a motor, and wherein the step of determining the drive power takes place through measurement of the RPM of the motor.

18. The method as recited in claim 11, wherein the drive comprises a hydraulic pump, and wherein the step of determining the drive power takes place through measurement of the hydraulic pressure produced by the hydraulic pump.

* * * * *